United States Patent [19]

Shirley

[11] Patent Number: 4,463,413

[45] Date of Patent: Jul. 31, 1984

[54] ADJUSTABLE PHOTOGRAPHIC LIGHT STAND

[76] Inventor: Howard L. Shirley, 514 Alhambra Rd., San Mateo, Calif. 94402

[21] Appl. No.: 527,208

[22] Filed: Aug. 29, 1983

[51] Int. Cl.[3] ..... F21V 21/20

[52] U.S. Cl. ..... 362/401; 362/18; 362/275; 362/287; 362/371; 362/417; 362/419; 362/427; 362/431

[58] Field of Search ..... 362/18, 275, 287, 401, 362/371, 419, 427, 417, 431

[56] References Cited

U.S. PATENT DOCUMENTS 4,181,929 1/1980 Barber et al. ..... 362/431
4,254,455 3/1981 Neal ..... 362/804

*Primary Examiner*—Stephen J. Lechert, Jr.
*Attorney, Agent, or Firm*—Harris Zimmerman; Howard Cohen

[57] ABSTRACT

An adjustable photographic light stand includes a base supported on rolling casters, and a column extending upwardly therefrom. An extendable boom arm is joined to the column by an adjustable carriage assembly which maintains the boom at any elevation along the column. A handle stored within the boom arm is extendable to raise or lower the carriage assembly and the boom arm. An L-shaped gimbal arm member is rotatably joined to the distal end of the extendable boom. A yoke member is rotatably joined to the distal end of the gimbal arm member, and is adapted to support a lamp head, X-ray unit, or the like. The yoke member provides rotational adjustment of the lamp head about two orthogonal axes, while the gimbal arm member provides for revolving adjustment about a third axis. The extendable boom arm provides lateral positioning of the lamp head, and the adjustable carriage assembly enables height adjustment of the unit.

19 Claims, 12 Drawing Figures

ADJUSTABLE PHOTOGRAPHIC LIGHT STAND

BACKGROUND OF THE INVENTION

In the field of photography, most professional photographers will acknowledge that to create a fine photographic image, the quality of the lighting is of the utmost importance. Indeed, lighting setup is often the most time consuming task in a photographic session. Lighting of a photographic subject involves a staggering number of interrelated variables. Often multiple lighting units must be reiteratively moved and redirected, filter combinations altered, and the like in a trial and error fashion to achieve the perfect lighting of the subject. However, most prior art lighting support devices are a hindrance in this process.

For example, some prior art devices employ counterweights to balance the lamp heads and minimize the stress imposed on the clamps which lock the lamp head in a desired position. However, if the photographer or artist wishes to change the lamp head or the filter pack, it may be necessary to rebalance the assembly before it can be directed at the subject and clamped in place. If this task must be done several times before the lighting is correct, a great amount of time and effort may be consumed.

Likewise, many prior art lighting devices use threaded clamping means to secure the lamp head about its various rotational and extensional axes. These devices require unscrewing and retightening the clamps for every alteration in the orientation of the lamp head. This feature can also consume a great deal of time and effort before the proper lighting effect is achieved.

Thus it is generally true that most, if not all, prior art photographic lighting devices are not capable of orienting the lamp head in any and all attitudes in a balanced state.

SUMMARY OF THE PRESENT INVENTION

The present invention generally comprises a lighting stand assembly which is designed particularly to provide the greatest freedom of movement of the lamp head in a perfectly balanced state, so that the artist or photographer may easily orient and redirect the lighting. The assembly virtually eliminates the time-consuming clamps and counterweights used in prior art devices.

The adjustable stand assembly for lamps and the like include a base supported on rolling casters, and a column extending upwardly therefrom. An extendable boom arm is joined to the column by an adjustable carriage assembly which raises and maintains the boom at any elevation along the column. A handle stored within the boom arm is extendable to raise or lower the bracket assembly and the boom arm. An L-shaped gimbal arm member is rotatably joined to the distal end of the extendable boom. A yoke member is rotatably joined to the distal end of the gimbal arm member, and is adapted to support a lamp head, X-ray unit, or any other device which must be supported, positioned, and oriented quickly and precisely. The lamp head is balanced about its yoke pivot axis, and the yoke member is balanced about its gimbal arm pivot axis. In addition, the pivot shaft joining the gimbal arm to the boom extends along an axis which generally passes through the center of gravity of the lamp head, yoke, and gimbal arm assembly. The yoke member provides rotational adjustment of the lamp head about two orthogonal axes, while the gimbal arm member provides for revolving adjustment about a third axis. The balanced condition of the rotating components enables movement thereof with little effort, and assures that the components will remain in any set position. The extendable boom arm provides lateral positioning of the lamp head, and the adjustable carriage assembly height adjustment of the unit.

BRIEF DESCRIPTION OF THE INVENTION

DESCRIPTION OF THE PREFERRED EMBODIMENT

Figures 1, 3, 4:
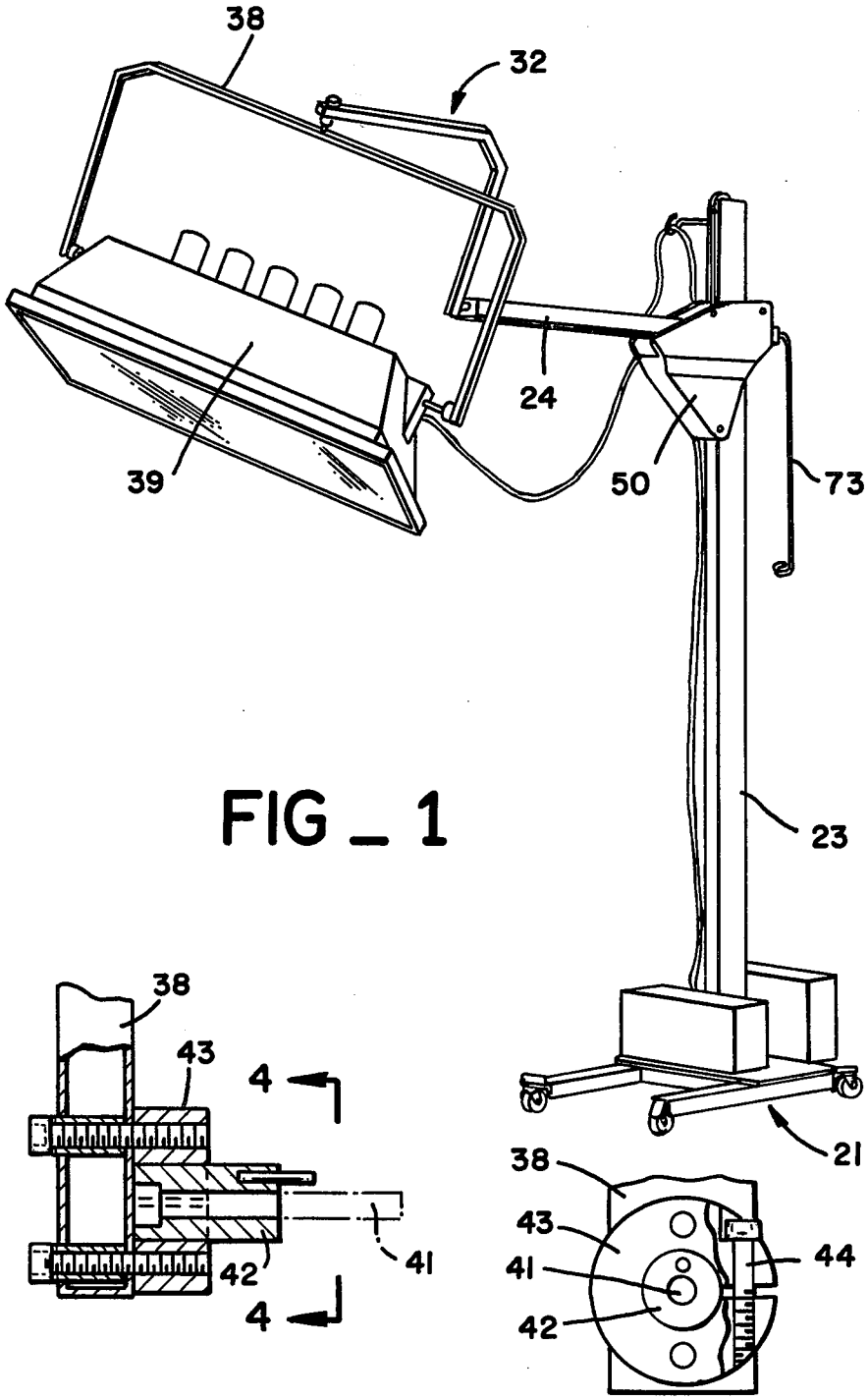
FIG. 1 is a perspective view of the adjustable lighting stand assembly of the present invention.
FIG. 3 is a cross-sectional elevation taken along line 3—3 of FIG. 2.
FIG. 4 is a partially cross-sectional view taken along line 4—4 of FIG. 3.
Figure 2:
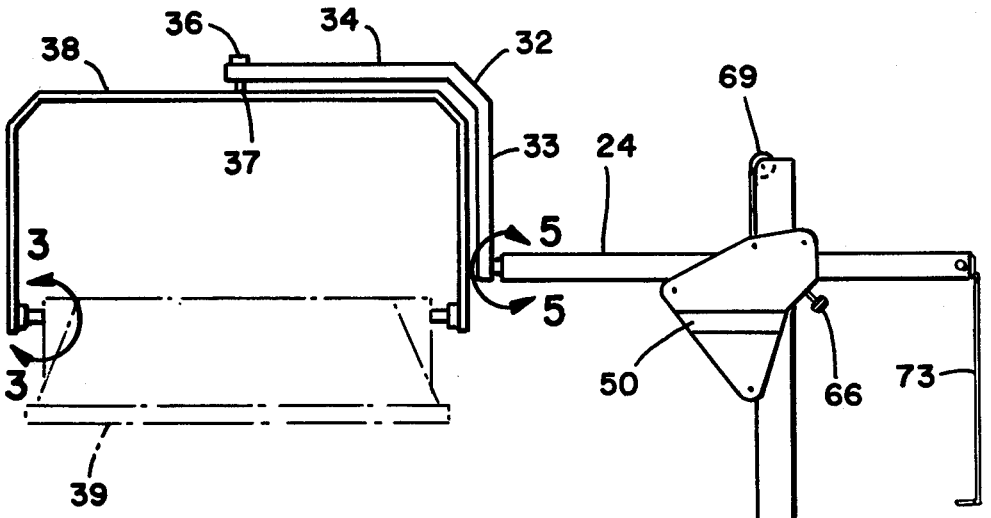
FIG. 2 is a side elevation of the adjustable lighting stand assembly.

The present invention generally comprises an adjustable stand assembly for lamp heads or any other device which requires precise orientation and positioning. With reference to FIGS. 1 and 2, the assembly includes a base 21 which is supported by a quartet of casters 22 secured thereto. A support column 23 is secured at its lower end to the base 21 and extends upwardly therefrom. In the preferred embodiment the column 23 comprises a hollow square steel tube section, or the like.

Figure 6:
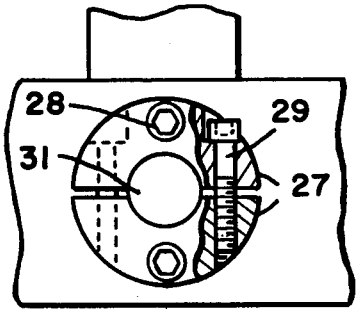
FIG. 6 is a cross-sectional view taken along line 6—6 of FIG. 5.
Figure 5:
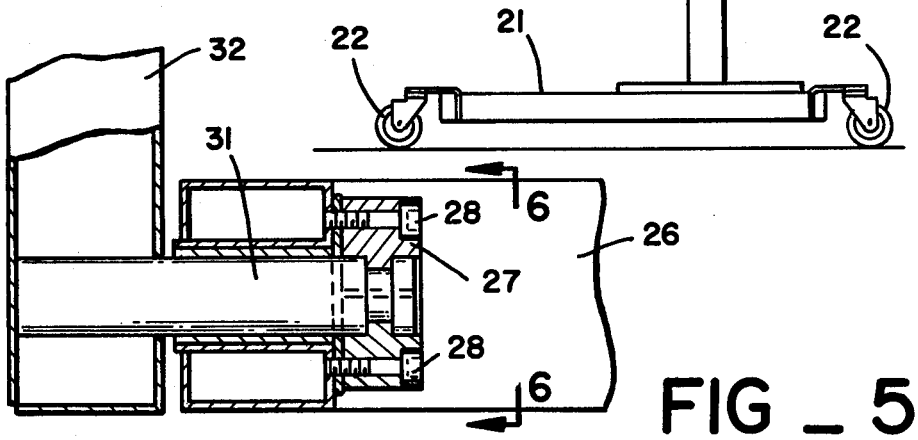
FIG. 5 is a cross-sectional view taken along line 5—5 of FIG. 2.
Figure 11:
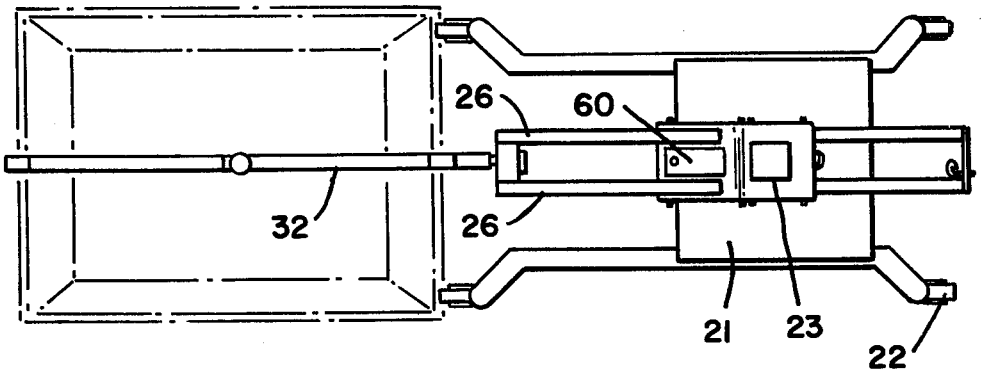
FIG. 11 is a top view of the present invention.
Figure 12:
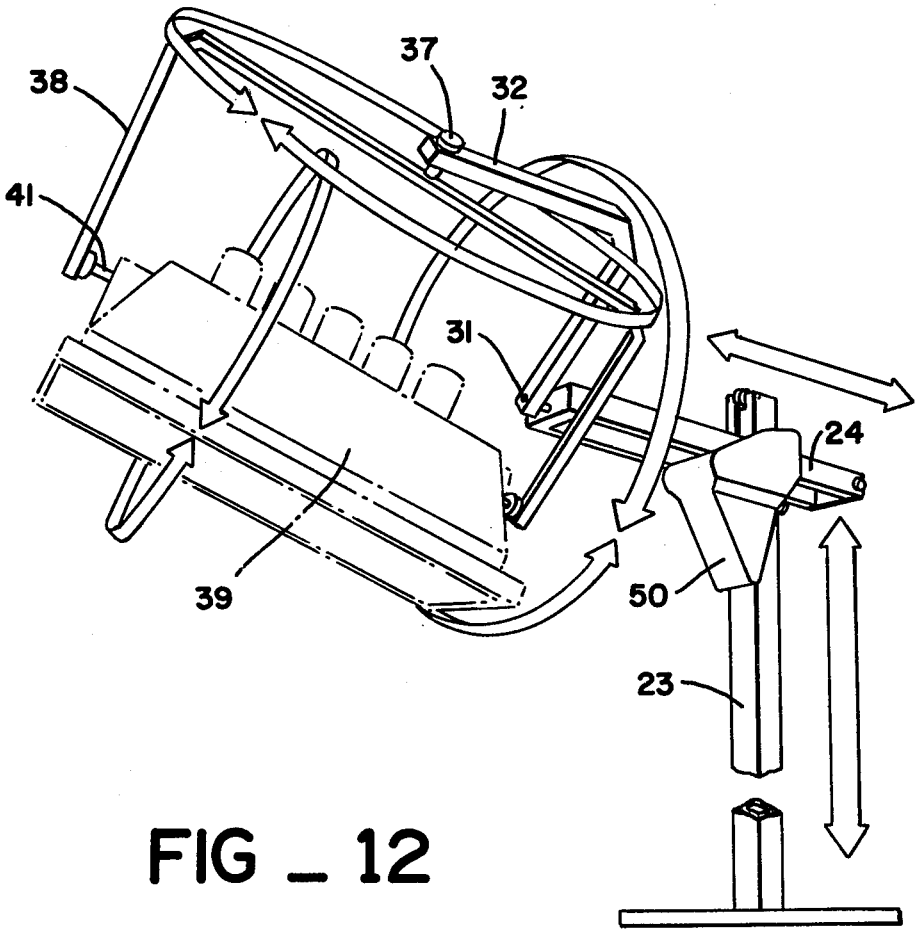
FIG. 12 is a diagrammatic perspective view of the present invention, showing the relative movement of the various components thereof.

The invention also includes a boom 24 extending laterally and secured to the column 23. With reference to FIGS. 11 and 12, the boom 24 comprises a pair of elongated rectangular steel tubes 26 extending in parallel, horizontal disposition and joined at opposite ends. The distal opposed end retains a split bearing 27, as shown in FIGS. 5 and 6. The bearing 27 is joined to a bearing journal by screws 28, and the halves of the bearing are joined by a pair of screws 29. A pivot shaft 31 is retained by the split bearing 27 in rotatable fashion; it may be appreciated that the screws 29 may be tightened or loosened to selectively adjust the friction of the bearing and the freedom of rotational motion of the shaft 31.

The invention further includes an L-shaped gimbal arm 32 having a pair of legs 33 and 34 extending in perpendicular fashion. The proximal end of the leg 33 is joined fixedly to the distal end of the shaft 31 in generally transverse fashion to the axis of the shaft. Secured to the distal end of the leg 34 is a split bearing assembly 36 similar to the one depicted in FIGS. 5 and 6. A pivot shaft 37 is secured in the bearing assembly 36 in rotating fashion.

The pivot shaft 37 is joined fixedly to the medial portion of a yoke member 38, so that the yoke member is balanced about the axis of the shaft 37. The yoke member is generally C-shaped, and is provided to secure a lamp head 39, or the like. With reference to FIGS. 3 and 4, the lamp head (or reflector, or the like) is provided with a pair of pivot shafts 41 extending outwardly from opposed ends thereof and received fixedly in one of a pair of bushings 42. Each bushing 42 in turn is received in one of a pair of adjustable, split ring clamping collars 43 which are joined to the opposed ends of the yoke member 38. Each of the clamping collars 43 includes a screw 44 which adjusts the frictional effect which attends the rotation of the respective bushing 42 and shaft 41. The axis of the shafts 41 extends through the center of gravity of the lamp head, so that the lamp head is balanced about the shafts 41. The axis of the shaft 37 also passes through the center of gravity of the lamp head and yoke assembly. In addition, the axis of pivot shaft 31 is disposed to pass generally through the center of gravity of the lamp head, yoke, and gimbal arm assembly. Thus these assemblies may be adjusted so that the lamp head 39 may be rotated easily by manual effort, yet will remain in the desired angular orientation, due to the fact that there are no substantial unbalanced forces acting thereon.

Figure 7:
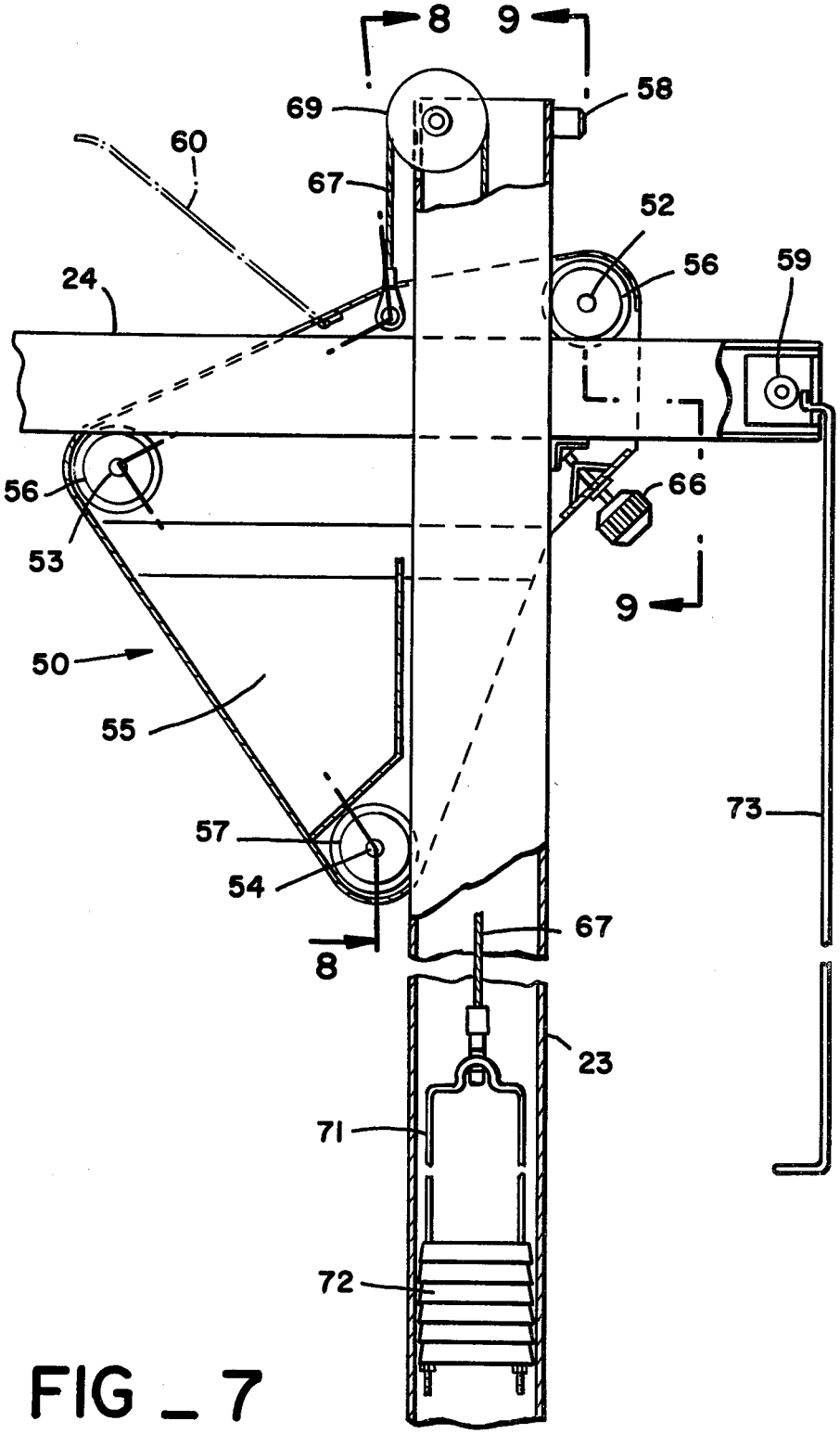
FIG. 7 is a partially cutaway side elevation of the adjustable carriage assembly of the present invention.
Figure 8:
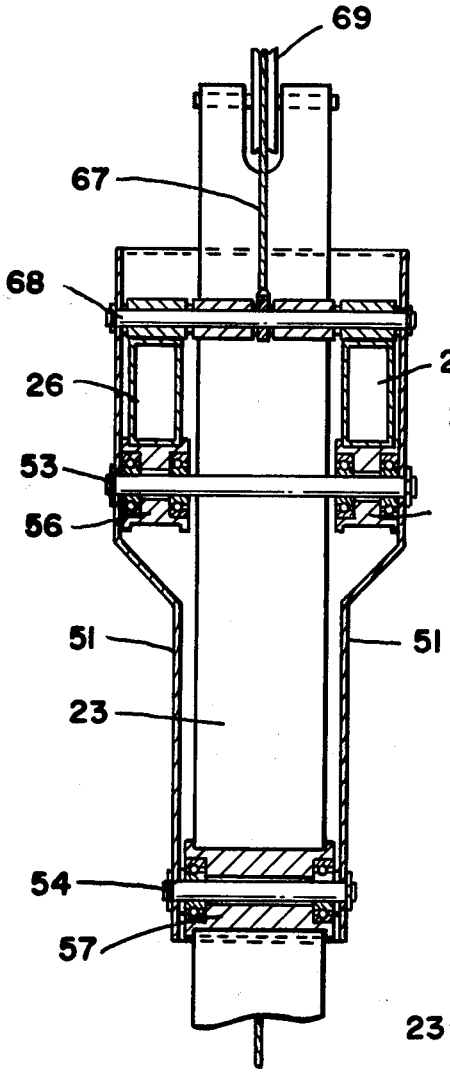
FIG. 8 is a cross-sectional view of the adjustable carriage assembly, taken along line 8—8 of FIG. 7.
Figure 9:
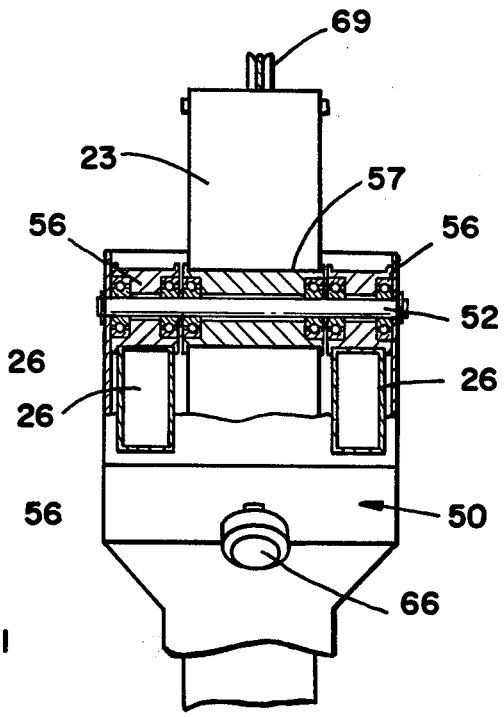
FIG. 9 is a partially cross-sectional view of the adjustable carriage assembly, taken along line 9—9 of FIG. 7.

A salient feature of the present invention is the provision of an adjustable carriage assembly 50 which allows the boom 24 to be moved along the column 23 and secured at any elevation therealong, and also permits the boom to be extended laterally with respect to the column. With reference to FIGS. 7–9, it may be appreciated that the tubular members 26 of the boom 24 are disposed outwardly of the column 23 and straddle the column. The carriage assembly 50 includes a pair of panels 51 having an irregular triangular configuration and disposed outwardly of the column 23 and of the tubular members 26. Extending between the panels 51 are a trio of axles 52, 53, and 54 disposed at the vertices of the panels and supported by ball bearings. The axles 52 and 53 each support a pair of guide rollers 56 which engage the upper and lower surfaces of the tubular members 26, respectively. The guide rollers include annular flanges which engage the laterally extending edge portions of the tubular members 26 to maintain proper alignment of the boom. The axles 52 and 54 each support a single guide roller 57 which is in rolling engagement with the column 23. Each guide roller 57 also includes annular flanges which engage the vertical edge portions of the column to maintain proper alignment of the carriage 50 on the column.

It may be appreciated that the axle 53 and its guide rollers support the boom 24 in cantilever fashion while permitting the boom to translate laterally over the rollers. The downward force of the cantilever engagement is applied to the axle 54 and its guide roller, which transfers this force to the column 23. The guide roller 57 also facilitates the smooth vertical translation of the assembly 50 over the column. The axle 52 receives the upward force created by the cantilever action of the boom, and likewise permits lateral rolling translation of the boom.

It should be noted that the upper end of the column 23 includes a stop lug 58 extending outwardly therefrom to limit the upward movement of the boom arm. The proximal end of the boom arm also includes a stop lug 59 extending outwardly therefrom to impinge upon the column 23 and limit the lateral movement of the boom arm with respect thereto.

Figure 10:
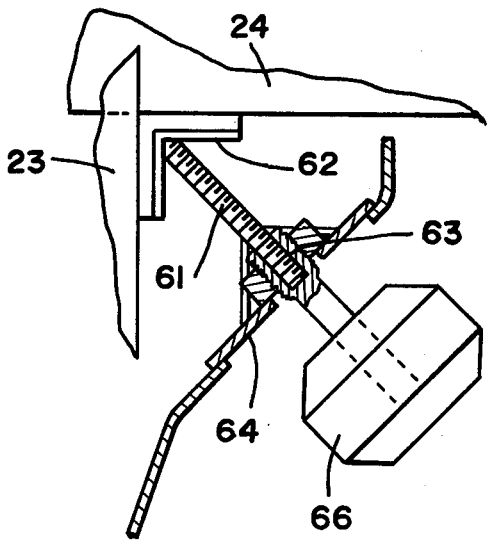
FIG. 10 is a cross-sectional view of the brake assembly of the adjustable carriage assembly.

The lateral and vertical position of the boom may be secured by means of a brake assembly depicted in FIG. 10. A threaded shaft 61 is joined at its inner end to an L-shaped brake pad 62 which is disposed to engage both a vertical surface of the column and the bottom surfaces of the tubular members 26 of the boom. The shaft 61 is received in a threaded hole in a bracket 64 which extends between the panels 51 of the assembly 50. A knob 66 is secured to the outer end of the shaft 61 to facilitate rotation of the shaft to drive the brake shoe into frictional engagement with the column and the boom. This engagement quickly locks the boom in place in both vertical and horizontal orientations.

The assembly 50 is supported by a cable 67 which is secured to a rod 68 extending between the panels 51, as shown in FIGS. 7 and 8. A pulley 69 is rotatably secured at the upper end of the column 23, and the cable 67 is passed over the pulley 69 to extend downwardly into the cavity of the hollow tubular column. Within that cavity, the cable is joined to a weight hanger 71 which supports a plurality of weights 72. The weights are substantially equal to the weight of the boom assembly, the bracket assembly 50, and the lamp head 39. Thus the weight of these components is counterbalanced, and little manual effort is required to raise or lower the boom assembly. Furthermore, rotation and reorientation of the yoke, lamp head, or gimbal arm does not change this balanced condition, so that no readjustment of this equilibrium is required.

The carriage assembly 50 is also provided with a ballast compartment 55 which is adapted to receive small weights which may be added or removed to accommodate changes in the total weight of the boom arm, lamp head, and the like. For example, a change in the filter pack or in the lamp head itself may require alteration of the ballast in the compartment 55. The carriage assembly includes a hinged door 60 which provides access to the ballast compartment 55.

The invention also includes a handle 73 which is engageable with the proximal end of the boom to aid in raising, lowering, or translating the boom. The handle may be stored within one of the tubular members 26 when not in use. It may be appreciated that the handle is quite a convenience, especially when the boom is translated upwardly to the full extent of the column 23.

As depicted graphically in FIG. 12, the present invention is designed to provide the greatest possible freedom of movement of the lamp head 39, with a minimum of adjustment of the assembly itself. The lamp head may be rotated about the axis of the shafts 41, and/or rotated about the shaft 37 which is transverse to the shaft 41, without altering the balanced state of these components. In addition, the gimbal arm member 32 may be revolved about the pivot shaft 31 for greater spatial freedom in positioning the lamp head. Due to the fact that the shaft 31 is disposed along an axis extending generally through the center of gravity of the gimbal arm, yoke, and lamp head assembly, rotation of the gimbal arm can likewise be accomplished without unbalancing the system. Furthermore, the boom 24 may be raised or lowered along the column 23 with slight manual effort, and may be translated laterally with little manual effort. The placement of the pivot axes at the balance points of the rotation components maintains the balanced condition of the parts in any orientation, obviating the need for clamps, locks, and the like known in the prior art. The only adjustment required when resetting the device is to release and reset the brake when the boom is translated vertically or laterally.

I claim:

1. An adjustable stand assembly for lamps and the like, including a base member, a column extending upwardly from said base member, a laterally extending boom arm, adjustable carriage assembly means for supporting, positioning, and maintaining said boom at any elevation along said column, an L-shaped gimbal arm, means for joining said gimbal arm at one end to said boom arm in rotatable fashion, a C-shaped yoke member means for joining said yoke member at a medial portion thereof to the other end of said gimbal bracket in rotatable fashion, and means at the distal ends of said yoke member to secure the lamp head in rotating fashion.

2. The adjustable stand assembly of claim 1, wherein said adjustable carriage assembly means includes at least one pair of guide rollers disposed to engage a vertically extending surface of said column.

3. The adjustable stand assembly of claim 2, wherein said adjustable carriage assembly means includes at least one pair of guide roller means disposed to engage a laterally extending surface of said boom arm in supporting fashion.

4. The adjustable stand assembly of claim 1, further including pulley means for supporting said adjustable bracket assembly means.

5. The adjustable stand assembly of claim 4, wherein said pulley means includes a pulley secured to the upper end of said column, and a cable secured at one end to said adjustable carriage assembly and extending over said pulley.

6. The adjustable stand assembly of claim 5, further including counterweight means secured to the other end of said cable, said counterweight means being substantially equal in weight to said adjustable carriage assembly means, said boom arm, said gimbal bracket, said yoke member, and the lamp head.

7. The adjustable stand assembly of claim 6, wherein said column comprises a hollow tubular member, said counterweight means being disposed within said hollow tubular member in vertically translatable fashion.

8. The adjustable stand assembly of claim 1, wherein said boom arm comprises a pair of hollow tubular members disposed in parallel, laterally extending relationship, and means for joining said hollow tubular members at opposed ends thereof.

9. The adjustable stand assembly of claim 8, further including means for supporting said column between said hollow tubular members in freely translating fashion.

10. The adjustable stand assembly of claim 9, further including handle means releasably secured to the other end of said boom arm and removeably storable in one of said hollow tubular members.

11. The adjustable stand assembly of claim 9, wherein said adjustable carriage assembly includes a first pair of guide rollers disposed to engage the lower lateral surfaces of said hollow tubular members of said boom arm.

12. The adjustable stand assembly of claim 11, wherein said adjustable carriage assembly includes a second pair of guide rollers disposed to engage the upper lateral surfaces of said hollow tubular members, said first and second pairs of guide rollers being disposed on laterally opposed sides of said columns.

13. The adjustable stand assembly of claim 12, wherein said adjustable carriage assembly further includes a third pair of guide rollers adapted to engage opposed vertical surfaces of said column, said third pair of guide rollers being disposed at vertically opposed sides of said boom arm.

14. The adjustable stand assembly of claim 1, wherein said adjustable carriage assembly further includes brake means for releasably securing said boom arm in any lateral and vertical position with respect to said column.

15. The adjustable stand assembly of claim 14, wherein said brake means includes brake shoe means disposed to impinge simultaneously on a vertical surface of said column and on a lateral surface of said boom arm.

16. The adjustable stand assembly of claim 15, further including threaded means for engaging and disengaging said brake shoe means with said vertical and lateral surfaces.

17. The adjustable stand assembly of claim 1, wherein said yoke member includes pivot shaft means for supporting said lamp head in balanced fashion, and said gimbal bracket includes pivot means joined to said yoke in supporting fashion, said pivot means extending along an axis passing generally through the center of gravity of the lamp head and yoke member assembly.

18. The adjustable stand assembly of claim 17, further including a pivot shaft joining said boom arm and said gimbal arm, said pivot shaft being disposed along an axis extending generally through the center of gravity of the lamp head, yoke member, and gimbal arm assembly.

19. The adjustable stand assembly of claim 1, wherein said adjustable carriage assembly includes ballast means for selectively counterbalancing alterations in the weight of said lamp head.

* * * * *